US010900106B2

(12) United States Patent
Kim et al.

(10) Patent No.: US 10,900,106 B2
(45) Date of Patent: Jan. 26, 2021

(54) FERRITIC STEEL

(71) Applicants: Hyundai Motor Company, Seoul (KR); Kia Motors Corporation, Seoul (KR)

(72) Inventors: Dong Hwi Kim, Gyeonggi-do (KR); Bong Lae Jo, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 42 days.

(21) Appl. No.: 15/978,422

(22) Filed: May 14, 2018

(65) Prior Publication Data

US 2019/0169720 A1 Jun. 6, 2019

(30) Foreign Application Priority Data

Dec. 4, 2017 (KR) ..... 10-2017-0165083

(51) Int. Cl.

| | |
|---|---|
| ***C22C 38/50*** | (2006.01) |
| ***C22C 38/46*** | (2006.01) |
| ***C22C 38/06*** | (2006.01) |
| ***C22C 38/04*** | (2006.01) |
| ***C22C 38/02*** | (2006.01) |
| ***C21D 6/00*** | (2006.01) |

(52) U.S. Cl.

CPC ..... *C22C 38/50* (2013.01); *C21D 6/004* (2013.01); *C21D 6/005* (2013.01); *C21D 6/008* (2013.01); *C22C 38/02* (2013.01); *C22C 38/04* (2013.01); *C22C 38/06* (2013.01); *C22C 38/46* (2013.01); *C21D 2211/005* (2013.01)

(58) Field of Classification Search

None

See application file for complete search history.

(56) References Cited

U.S. PATENT DOCUMENTS

2010/0300585 A1* 12/2010 Perlade ..... C21D 8/021 148/547

FOREIGN PATENT DOCUMENTS

| | | |
|---|---|---|
| KR | 10-2010-0019443 | 2/2010 |
| KR | 10-2017-0005251 | 1/2017 |

* cited by examiner

*Primary Examiner* — Xiaowei Su

(74) *Attorney, Agent, or Firm* — Mintz Levin Cohn Ferris Glovsky and Popeo, P.C.; Peter F. Corless

(57) ABSTRACT

Disclosed herein is a ferritic steel having decreased specific gravity and having excellent mechanical strength by suppressing formation of κ-carbide. The ferrite steel may include: carbon (C) in an amount of about 0.05 to 0.12 wt %; aluminum (Al) in an amount of about 3.0 to 7.0 wt %; manganese (Mn) in an amount of about 0.5 wt % or less (not 0%); nickel (Ni) in an amount of about 0.5 wt % or less (not 0%); chromium (Cr) in an amount of about 0.75 wt % or less (not 0%); silicon (Si) in an amount of about 0.3 to 0.75 wt %; a combined amount of titanium (Ti) and vanadium (V) in an amount of about 0.25 to 0.7 wt %; and a balance being iron (Fe), all the wt % are based on the total weight of the ferritic steel.

10 Claims, 6 Drawing Sheets

FIG. 1

| CLASSIFICATION | C | Al | Mn | Ti+V | Si | Ni | Cr |
|---|---|---|---|---|---|---|---|
| EXAMPLE1 | 0.12 | 6 | 0.5 | 0.5 | 0.5 | 0.2 | 0.3 |
| EXAMPLE2 | 0.12 | 7 | 0.5 | 0.6 | 0.3 | 0.2 | 0.3 |
| COMPARATIVE EXAMPLE1 | 0.07 | 0.25 | 0.5 | 0.5 | 0.3 | 0.25 | 0.1 |
| COMPARATIVE EXAMPLE2 | 0.04 | 4 | 0.5 | 0.2 | 0.25 | 0.1 | 0.1 |
| COMPARATIVE EXAMPLE3 | 0.03 | 7 | 0.5 | 0.2 | 0.25 | 0.1 | 0.1 |
| COMPARATIVE EXAMPLE4 | 0.05 | 6 | 0.5 | 0.1 | 0.75 | 0.2 | 0.1 |
| COMPARATIVE EXAMPLE5 | 0.05 | 6 | 0.5 | 0.2 | 0.75 | 0.2 | 0.1 |
| COMPARATIVE EXAMPLE6 | 0.12 | 6 | 0.1 | 0.4 | 0.5 | 0.5 | 0.3 |
| COMPARATIVE EXAMPLE7 | 0.12 | 6 | 0.5 | 0.4 | 0.5 | 0.6 | 0.3 |
| COMPARATIVE EXAMPLE8 | 0.12 | 7.5 | 0.5 | 0.4 | 0.5 | 0.2 | 0.3 |
| COMPARATIVE EXAMPLE9 | 0.12 | 7.5 | 0.5 | 0.4 | 0.1 | 0.2 | 0.5 |
| COMPARATIVE EXAMPLE10 | 0.12 | 7.5 | 0.5 | 0.4 | 0.5 | 0.2 | 0.1 |
| COMPARATIVE EXAMPLE11 | 0.15 | 6 | 0.5 | 0.3 | 0.3 | 0.2 | 0.2 |

FIG. 2

| CLASSIFICATION | YIELD STRENGTH | TENSILE STRENGTH | ELONGATION | DENSITY | FRACTION OF κ-CARBIDE |
|---|---|---|---|---|---|
| EXAMPLE1 | 573 MPa | 611 MPa | 13% | 7.19 g/㎤ | X |
| EXAMPLE2 | 573 MPa | 611 Mpa | 11% | 7.18 g/㎤ | 0.7% |
| COMPARATIVE EXAMPLE1 | 553 MPa | 601 MPa | 5% | 7.71 g/㎤ | 1.3% |
| COMPARATIVE EXAMPLE2 | 387 MPa | 437 MPa | 16% | 7.42 g/㎤ | X |
| COMPARATIVE EXAMPLE3 | 399 MPa | 432 Mpa | 19% | 7.13 g/㎤ | X |
| COMPARATIVE EXAMPLE4 | 489 Mpa | 507 Mpa | 17% | 7.30 g/㎤ | 0.8% |
| COMPARATIVE EXAMPLE5 | 495 MPa | 518 Mpa | 10% | 7.32 g/㎤ | 0.9% |
| COMPARATIVE EXAMPLE6 | 549 MPa | 591 Mpa | 11% | 7.20 g/㎤ | 1.3% |
| COMPARATIVE EXAMPLE7 | 557 MPa | 609 MPa | 13% | 7.19 g/㎤ | 1.3% |
| COMPARATIVE EXAMPLE8 | 551 MPa | 601 MPa | 9% | 7.13 g/㎤ | 1.5% |
| COMPARATIVE EXAMPLE9 | 577 MPa | 619 MPa | 7% | 7.10 g/㎤ | 2.4% |
| COMPARATIVE EXAMPLE10 | 550 MPa | 579 MPa | 7% | 7.10 g/㎤ | 2.4% |
| COMPARATIVE EXAMPLE11 | 627 MPa | 655 MPa | 8% | 7.16 g/㎤ | 4.3% |

FIGS. 4A
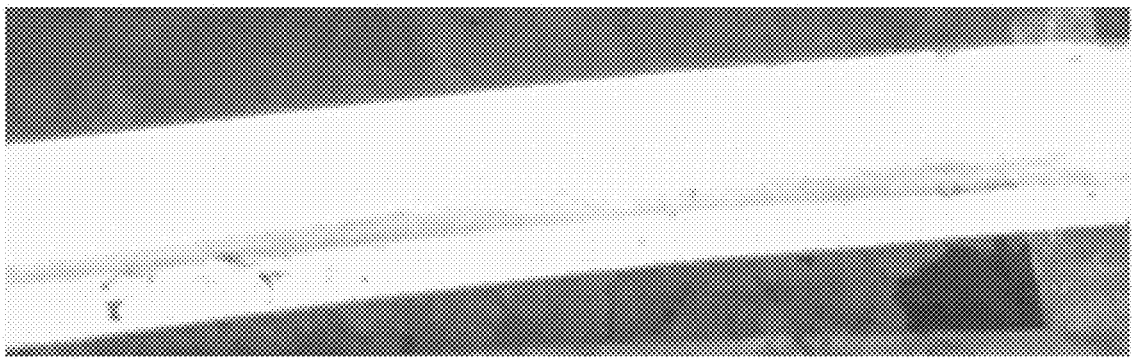
EXAMPLE 1
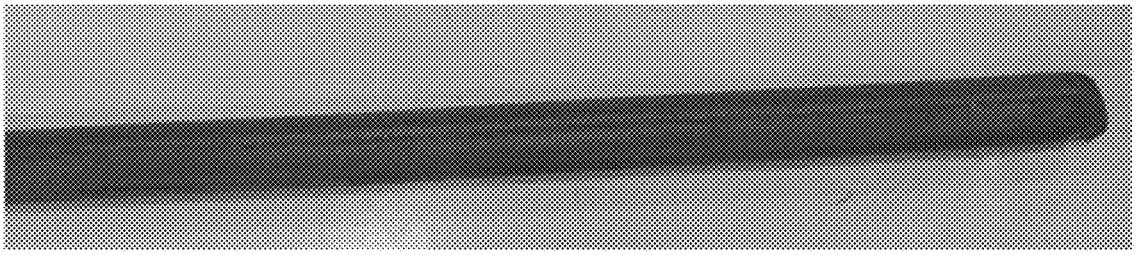
EXAMPLE 2

FIGS. 4B
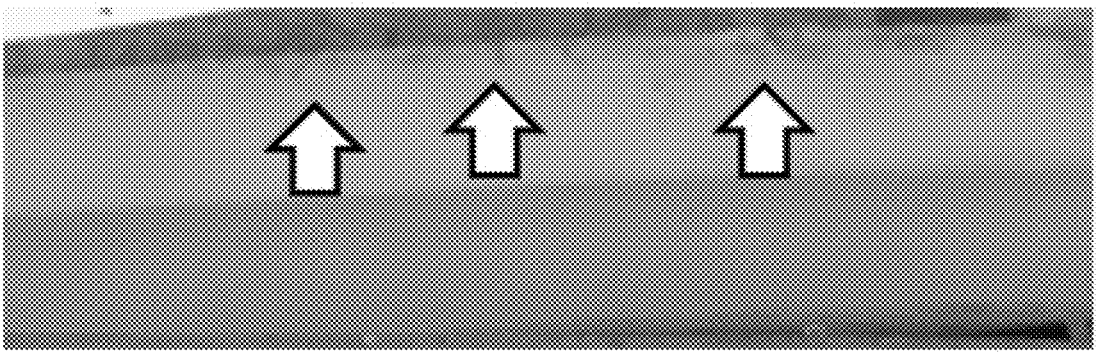
COMPARATIVE EXAMPLE 8
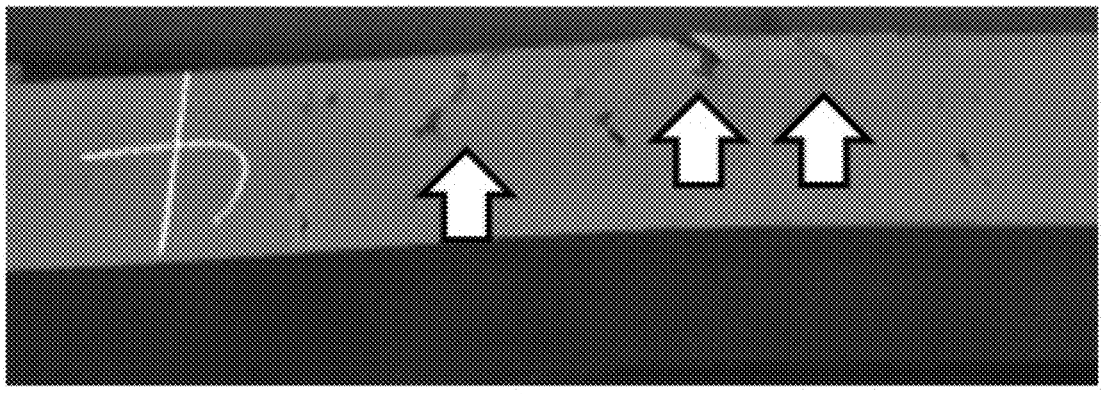
COMPARATIVE EXAMPLE 9
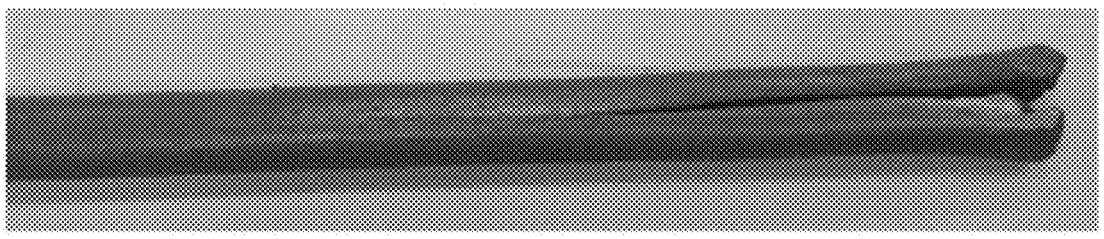
COMPARATIVE EXAMPLE 11

FERRITIC STEEL

CROSS REFERENCE TO RELATED APPLICATION

The present application claims priority to Korean Patent Application No. 10-2017-0165083, filed Dec. 4, 2017, the entire contents of which is incorporated herein for all purposes by this reference.

TECHNICAL FIELD

The present invention relates to a ferritic steel having decreased specific gravity while maintaining excellent mechanical strength by suppressing formation of κ-carbide therein.

BACKGROUND

In order to improve fuel efficiency of a vehicle, research for reducing a weight of a material has been continuously conducted. For instance, research for reducing a weight of each component made of a steel material of the vehicle components has been continuously conducted.

In the related art, ferritic lightweight steel, austenitic lightweight steel, ferrite-austenite dual phase (duplex) lightweight steel, and the like have been used. Since this lightweight steel contains a large amount of A1 in a steel material to have high specific strength, this lightweight steel has been spotlighted as an advanced structural material such as a vehicle component.

For instance, since the ferritic lightweight steel may not need additional alloy material for austenite stabilization, the ferritic lightweight steel may be more economical than other kinds of lightweight steel in view of cost of an alloy. However, the ferritic lightweight steel may include a kappa (κ)-phase that may be formed from components of the ferritic lightweight steel, when heat treatment and the components are not added in the optimal conditions, and thus formability may be deteriorated due to excessive precipitation of the κ-phase.

SUMMARY OF THE INVENTION

In preferred aspects, the present invention provides a ferritic steel and a composition thereof. The ferritic steel may have decreased specific gravity while maintaining excellent mechanical strength by suppressing formation of a κ-phase. Accordingly, the ferritic steel may be suitably used in a vehicle component to which various heat treatments need to be applied.

In one aspect, provided is a ferrite steel. The ferrite steel may include: carbon (C) in an amount of about 0.05 to 0.12 wt %; aluminum (Al) in an amount of about 3.0 to 7.0 wt %; manganese (Mn) in an amount of about 0.5 wt % or less (not 0 wt %); nickel (Ni) in an amount of about 0.5 wt % or less (not 0 wt %); chromium (Cr) in an amount of about 0.75 wt % or less (not 0 wt %); silicon (Si) in an amount of about 0.3 to 0.75 wt %; a combined amount of titanium (Ti) and vanadium (V) in an amount of about 0.25 to 0.7 wt %; and a balance being iron (Fe), all the wt % are based on the total weight of the ferritic steel.

The ferrite steel may further include other materials particularly niobium (Nb) in an amount of about 0.02 wt % or less, phosphorus (P) in an amount of about 0.1 wt % or less, sulfur (S) in an amount of about 0.05 wt % or less, nitrogen (N) in an amount of about 0.01 wt % or less, or a combination thereof, all the wt % based on the total weight of the ferric steel. It is understood that these additional materials, if present, would be in amount of greater than 0, such as about 0.01 wt %, all the wt % based on the total weight of the ferric steel.

The ferritic steel may essentially consist of, consist essentially of, or consist of the components as described herein. For instance, the ferritic steel may essentially consist of, consist essentially of, or consist of: carbon (C) in an amount of about 0.05 to 0.12 wt %; aluminum (Al) in an amount of about 3.0 to 7.0 wt %; manganese (Mn) in an amount of about 0.5 wt % or less (not 0 wt %); nickel (Ni) in an amount of about 0.5 wt % or less (not 0 wt %); chromium (Cr) in an amount of about 0.75 wt % or less (not 0 wt %); silicon (Si) in an amount of about 0.3 to 0.75 wt %; a combined amount of titanium (Ti) and vanadium (V) in an amount of about 0.25 to 0.7 wt %; and a balance being iron (Fe), all the wt % are based on the total weight of the ferritic steel.

Moreover, the ferritic steel may essentially consist of, consist essentially of, or consist of: carbon (C) in an amount of about 0.05 to 0.12 wt %; aluminum (Al) in an amount of about 3.0 to 7.0 wt %; manganese (Mn) in an amount of about 0.5 wt % or less (not 0 wt %); nickel (Ni) in an amount of about 0.5 wt % or less (not 0 wt %); chromium (Cr) in an amount of about 0.75 wt % or less (not 0 wt %); silicon (Si) in an amount of about 0.3 to 0.75 wt %; a combined amount of titanium (Ti) and vanadium (V) in an amount of about 0.25 to 0.7 wt %; niobium (Nb) in an amount of about 0.02 wt % or less, phosphorus (P) in an amount of about 0.1 wt % or less, sulfur (S) in an amount of about 0.05 wt % or less, nitrogen (N) in an amount of about 0.01 wt % or less, or a combination thereof; and a balance being iron (Fe), all the wt % are based on the total weight of the ferritic steel.

The ferritic steel may have yield strength of about 500 Mpa or greater, preferably, of about 570M pa or greater.

The ferritic steel may have tensile strength of about 540 Mpa or greater, preferably, of about 611 Mpa or greater.

The ferritic steel may have an elongation of about 10% or greater.

The ferritic steel may have a density of about 7.0 to 7.5 $g/cm^3$.

In the ferritic steel, a fraction of formed κ-carbide may be less than about 1%.

Further provided is a vehicle that may include the ferritic steel as described herein.

Other aspects of the invention are disclosed infra.

BRIEF DESCRIPTION OF THE DRAWINGS

FIG. 1 is a table of compositions in Examples and Comparative Examples;

FIG. 2 is a table of physical properties and performance in Examples and Comparative Examples;

FIGS. 4A and 4B are photographs of products in Examples and Comparative Examples.

DETAILED DESCRIPTION

Figure 3A:
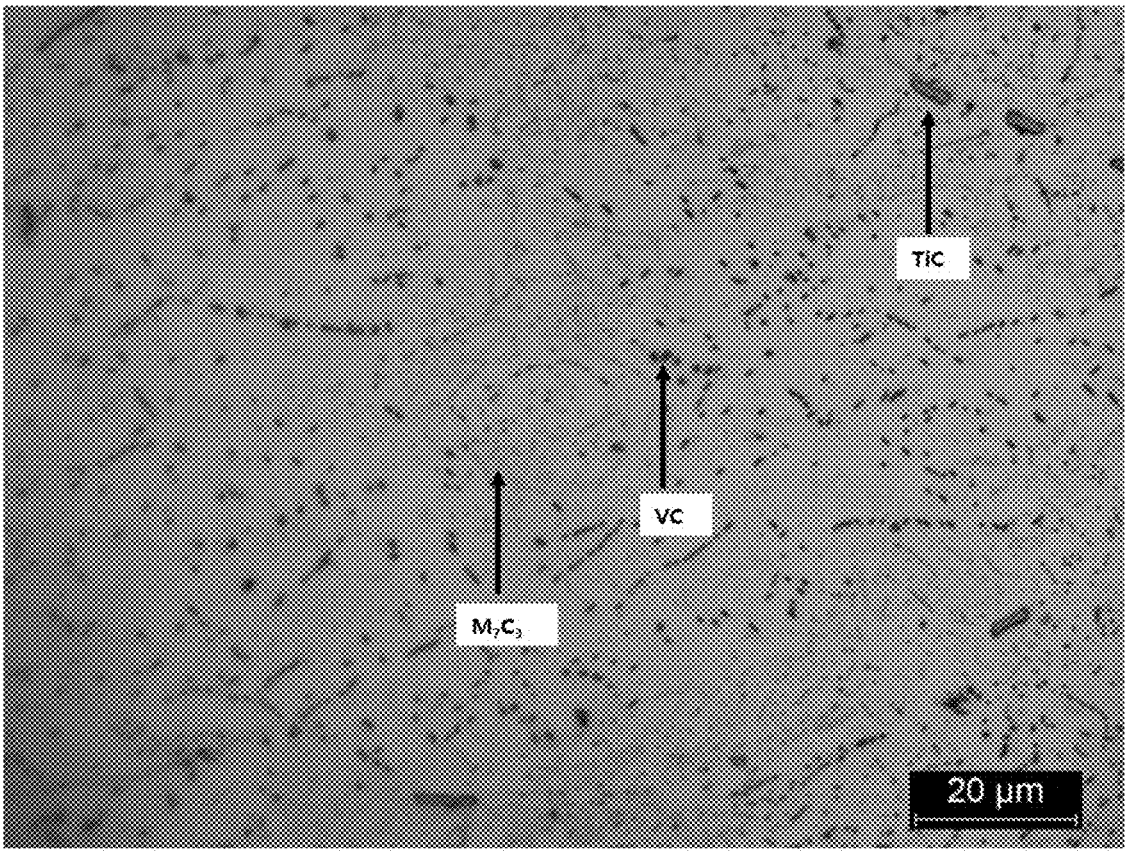
FIGS. 3A and 3B are photographs of micro structures observed in Examples.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprise", "include", "have", etc. when used in this specification, specify the presence of stated features, regions, integers, steps, operations, elements and/or components but do not preclude the presence or addition of one or more other features, regions, integers, steps, operations, elements, components, and/or combinations thereof.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Ferritic steel as described herein may be utilized in a variety of ways, for instance, as a material of construction of vehicle body, engine component, of the other vehicle component.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, exemplary embodiments of the present invention will be described in detail with reference to the accompanying drawings. However, the present invention is not limited to the exemplary embodiments disclosed herein but will be implemented in various forms. The present exemplary embodiments make invention of the present invention thorough and are provided so that those skilled in the art can easily understand the scope of the present invention.

FIG. 1 is a table illustrating ingredients in Examples and Comparative Examples, and FIG. 2 is a table illustrating physical properties and performance in Examples and Comparative Examples.

In one aspect, a ferritic steel according to an exemplary embodiment of the present invention, formation of κ-carbide is suppressed by optimizing contents of main alloy ingredients. The ferrite steel may include: carbon (C) in an amount of about 0.05 to 0.12 wt %; aluminum (Al) in an amount of about 3.0 to 7.0 wt %; manganese (Mn) in an amount of about 0.5 wt % or less (not 0 wt %); nickel (Ni) in an amount of about 0.5 wt % or less (not 0 wt %); chromium (Cr) in an amount of about 0.75 wt % or less (not 0 wt %); silicon (Si) in an amount of about 0.3 to 0.75 wt %; a combined amount of titanium (Ti) and vanadium (V) in an amount of about 0.25 to 0.7 wt %; and a balance being iron (Fe), all the wt % are based on the total weight of the ferritic steel.

In the present invention, the reason to restrict the alloy ingredients and composition range thereof is as follows. Hereinafter, unless particularly described, the term "%" disclosed as a unit of the composition range means "weight % (wt %)".

Preferably, a content of carbon (C) may be about 0.05 to 0.12 wt % based on the total weight of the ferritic steel. Although carbon (C) may be an element effective in improving strength of steel, since a fraction of κ-carbide is increased as the amount of the carbon is increased, the content of carbon (C) may be limited up to about 0.12 wt % which may correspond to a high-temperature solubility limit of carbon (C) in BCC (Body Centered Cubic). Further, when the content of the carbon is of about or greater than 0.05 wt %, which may correspond to a low-temperature solubility limit of carbon (C) in a low-temperature BCC, an effect of enhancing strength through formation of carbide may be obtained. The term "BCC" as used herein may include a stable crystal structure of the ferrite steel, for example, at room temperature.

Preferably, a content of aluminum (Al) may be about 3.0 to 7.0 wt % based on the total weight of the ferritic steel. In the related art, aluminum may effectively decrease a specific gravity of a material at the time of adding aluminum to an alloy. When the aluminum is included in the amount greater than the predetermined amount, e.g., greater than 7 wt %, at which an equilibrium phase of κ-carbide is not present in an entire temperature range, a large amount of κ-carbide may be precipitated. Further, when the aluminum is included in the amount less than the predetermined amount, e.g., less than about 3 wt %, a decrease in specific gravity may be insufficient, and a matrix structure may be mainly formed of austenite, such that there is no difference with a material according to the related art.

Preferably, the contents of manganese (Mn) and nickel (Ni) may be each 0.5 wt % or less (not 0 wt %) based on the total weight of the ferritic steel. When the amounts of manganese (Mn) and nickel (Ni) are added greater than the predetermined amount, e.g., greater than about 0.5 wt %, κ-carbide may be formed in austenite.

Preferably, a content of chromium (Cr) may be about 0.75 wt % or less (not 0 wt %) based on the total weight of the ferritic steel. Although chromium (Cr) is a ferrite stabilizing element, since chromium (Cr) may cause brittleness at the time of adding a large amount of chromium (Cr), the content of chromium may be included up to about 0.75 wt % or less.

Preferably, a content of silicon (Si) may be about 0.3 to 0.75 wt % based on the total weight of the ferritic steel. Silicon (Si) as used herein may be a ferrite stabilizing element similarly to chromium (Cr), and the content may be added in an amount of 0.3 wt % or greater in order to form a stable ferrite phase. When the silicon is added greater than the predetermined amount, e.g., greater than about 0.75 wt %, silicon (Si) may also cause brittleness, similarly to chromium (Cr). Preferably, a combined content of titanium (Ti) and vanadium (V) may be of about 0.25 to 0.7 wt % based on the total weight of the ferritic steel. Titanium (Ti) and vanadium (V) as used herein may improve strength and suppress formation of κ-carbide by forming micro-carbide at a high temperature of about 1200° C. or greater when titanium (Ti) and vanadium (V) are each added alone or added in combination. Therefore, in order to suppress formation of κ-carbide, because the upper limit of the content of carbon (C) is about 0.12 wt %, a theoretical maximum combined content of Ti and V may be about 0.48 wt %. However, because other elements such as nitrogen (N), oxygen (O), or the like may bind with Ti or V, the combined content may be about or less than 0.7 wt %. Further, the combined content thereof may be of about or greater than 0.25 wt % to prevent strength decreased due to unformation of κ-carbide by formation of TiC and VC.

The ferritic steel may further include niobium (Nb) in an amount of about 0.02 wt % or less, phosphorus (P) in an amount of about 0.1 wt % or less, sulfur (S) in an amount of about 0.05 wt % or less, nitrogen (N) in an amount of about 0.01 wt % or less, or a combination thereof, based on the total weight of the ferritic steel.

In order to maximize effects of Ti and V, a content of niobium (Nb) may be included of about or less than about 0.02 wt % based on the total weight of the ferritic steel.

Since phosphorus (P) and sulfur (S) may be impurities, contents of phosphorus (P) and sulfur (S) may be limited as low as possible, but in consideration of a removal process of phosphorus (P) and sulfur (S), the content of phosphorus (P) may be of about or less than about 0.1 wt %, and a the content of sulfur (S) may be of about or less than about 0.05 wt %.

Preferably, a content of nitrogen (N) may be controlled as low as possible in order to suppress formation of nitrides of Ti, V, Al, and the like, and in consideration of a removal process, the content of nitrogen (N) may be of about or less than about 0.01 wt % based on the total weight of the ferritic steel.

Meanwhile, the balance except for the above-mentioned ingredient may be Fe and other inevitable impurities.

Hereinafter, the present invention will be described in more detail with reference to Examples and Comparative Examples.

An experiment of producing steel bar according to Examples and Comparative Examples was performed depending on production conditions of commercially produced steel bar, and blooms manufactured through molten steel produced while changing contents of respective ingredients as illustrated in FIG. 1 was sequentially subjected to a hot rough rolling process, a heat treatment process, a primary warm rolling process, a primary annealing process, a secondary warm rolling process, a secondary annealing process, and a cold rolling process, thereby manufacturing the steel bar. Contents of Nb, P, S, and N corresponding to alloy elements that are not illustrated in Table 1 were controlled to be as low as possible, and upper limits thereof were adjusted so as not to exceed the upper limits limited in the present invention.

The manufactured bloom was re-heated in a temperature section of 1000 to 1300° C. at a rate of 2 minutes per thickness 1 mm for the hot rough rolling process. Here, in order to maximize an effect of precipitating carbides of titanium and vanadium, an additional heat treatment process may be further performed thereon at the above-mentioned reheating temperature at a rate of 1 hour per thickness 25 mm. The re-heated bloom was subjected to a rolling process at a temperature of 800° C. or greater at a reduction ratio of 3.5 or greater, thereby manufacturing a billet.

The rolled billet was subjected to the primary warm rolling process in a temperature section of 700 to 1000° C. to thereby be formed in a form of steel bar or coil. Then, the rolled steel bar or coil may be subjected to the primary annealing process in a temperature section of 600 to 900° C.

The primarily annealed steel bar or coil may be subjected to the secondary warm rolling process in a temperature section of 500 to 850° C., and the secondary rolled steel bar or coil may be subjected to the secondary annealing process in a temperature section of 650 to 850° C.

The secondarily annealed steel bar or coil as described above may be subjected to the cold rolling process for final size correction.

Next, test methods for confirming physical properties of the steel bar manufactured according to Examples and Comparative Examples as described above will be described.

Tests for confirming yield strength, tensile strength, elongations, densities, and fractions of κ-carbide of respective test samples according to Examples and Comparative Examples were performed, and the results are illustrated in FIG. 2.

Here, the respective test samples according to Examples and Comparative Examples were processed so as to satisfy ASTM E 8 specifications for a steel bar standard sample at a position of ½R of steel bar rolled at Φ35.

In addition, the test sample was evaluated according to ASTM E 8 test methods at a temperature of 25° C. and a humidity of 65% using a uniaxial tensile tester with a maximum load capacity of 250 kN, thereby measuring the yield strength, tensile strength, and elongation.

Further, the density of the test sample was measured according to ASTM D 792 method A.

Meanwhile, the fraction of κ-carbide was determined by primarily measuring a fraction of κ-carbide of a test sample weakly polished after mirror polishing and then verifying consistency with an image analysis result after Lepera color etching.

As illustrated in FIG. 2, in Examples according to the present invention, yield strength, tensile strength, elongation, density, and the fraction of κ-carbide all satisfied requirements according to the present invention.

For example, in Examples 1 and 2 according to the present invention, the yield strength was maintained to be 500 Mpa or greater, and preferably, the yield strength was 570 Mpa or greater.

Further, in Examples 1 and 2 according to the present invention, the tensile strength was maintained to be 540 Mpa or greater, and preferably, the tensile strength was 611 Mpa or greater.

Further, in Examples 1 and 2 according to the present invention, the elongation was maintained to be 10% or greater, and the density was in a range of 7.0 to 7.5 g/cm$^3$.

Furthermore, in Examples 1 and 2 according to the present invention, the fraction of the formed κ-carbide was less than 1%.

On the contrary, in Comparative Example 1, a content of Al was insufficient, such that there was no effect of decreasing specific gravity, a fraction of κ-carbide exceeded the requirement (less than 1%) of the present invention, and an austenite phase matrix was formed.

In Comparative Examples 2 to 5, contents of Ti and V were insufficient, such that TiC and VC were insufficiently formed. As a result, yield strength and tensile strength did not satisfy the requirement of the present invention.

In Comparative Examples 6 and 7, yield strength, tensile strength, and density satisfied the requirements of the present invention, but a content of Mn or Ni was excessively high, such that a fraction of κ-carbide exceeded the requirement of the present invention.

In Comparative Examples 8 to 10, yield strength, tensile strength, elongation, and density satisfied the requirements of the present invention, but a content of Al was excessively high, such that a fraction of κ-carbide exceeded the requirement of the present invention.

In Comparative Example 11, yield strength, tensile strength, elongation, and density satisfied the requirements of the present invention, but a content of C was excessively high, such that a fraction of κ-carbide exceeded the requirement of the present invention.

Figure 3B:
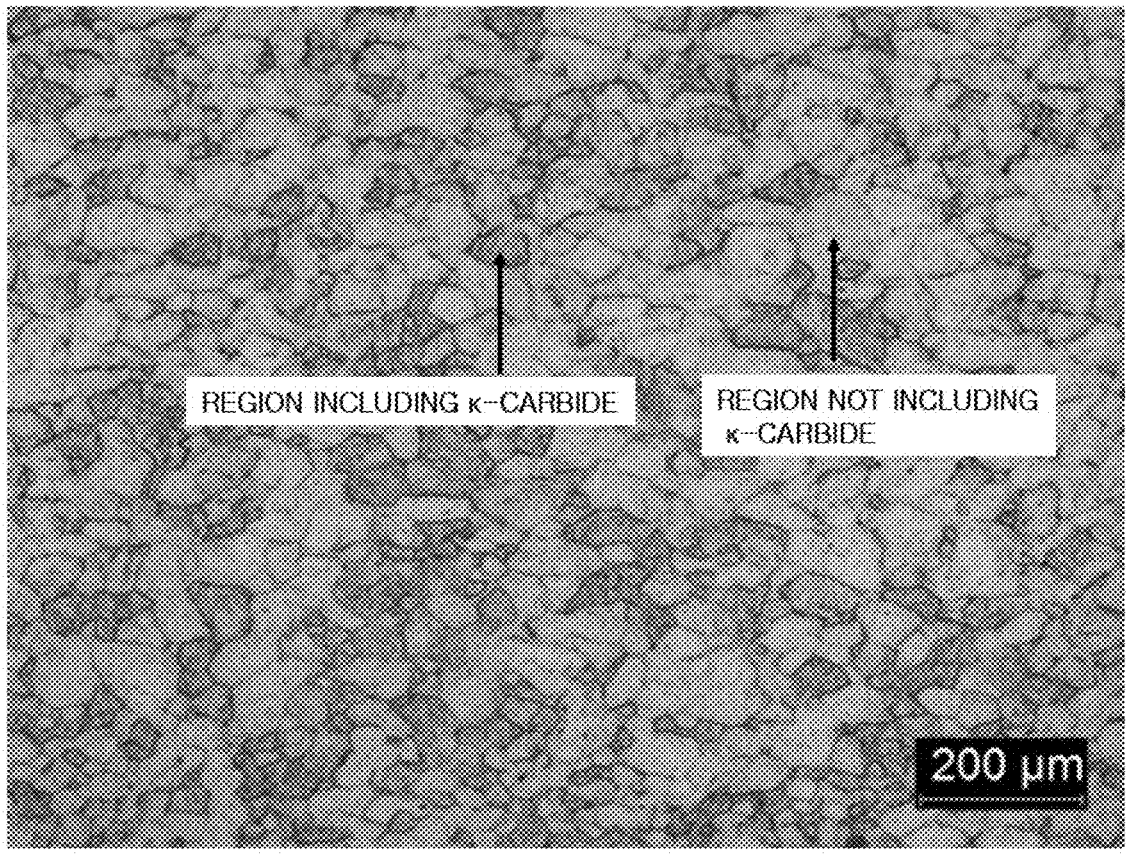

Meanwhile, FIG. 3A is a photograph of a micro structure in Example 1 and FIG. 3B is a photograph of micro structure in Example 2.

As illustrated in FIG. 3A, in Example 1, precipitates such as TiC, VC, and M7C3 were formed in a ferritic matrix structure, and precipitation of κ-carbide was not observed.

As illustrated in FIG. 3B, it may be confirmed that in Example 2, precipitates such as TiC, VC, and M7C3 were formed in a ferritic matrix structure, and a fraction of precipitated κ-carbide was less than 1%.

Further, FIG. 4A, which is a photograph illustrating products in Examples 1 and 2, is a photograph of products during and after rolling the products in a form of steel bar. As illustrated in FIG. 4A, it may be confirmed that in Examples according to the present invention, rolling was normally performed, and surface quality of the product was excellent.

FIG. 4B, which is a photograph illustrating products in Examples 8, 9, and 11, is a photograph of products during and after rolling the products in a form of steel bar. As illustrated in FIG. 4B, it may be confirmed that in Comparative Examples 8 and 9 corresponding to test samples in which fractions of precipitated κ-carbide were about 1.5% and 2.4%, respectively, cracks occurred in a surface during the rolling. Further, it may be confirmed that in Comparative Example 11 corresponding to a test sample in which fractions of precipitated κ-carbide was about 4.3%, bursting occurred during the rolling.

According to the exemplary embodiment of the present invention, as formation of the κ-carbide is suppressed by adjusting contents of main alloy ingredients, the ferritic lightweight steel capable of securing an elongation of 10% or greater and decreasing specific gravity while maintaining excellent yield strength and tensile strength may be obtained.

In ferritic low specific gravity lightweight steel according to the related art, about 1 to 30% of κ-carbide is formed due to relatively high contents of Al and C. However, according to the embodiment of the present invention, formation of κ-carbide may be suppressed by suppressing the content of Al in a range of 7% or less so as to allow a stable phase of the κ-carbide not to exist and controlling an amount of solute carbon in a matrix at a significantly low level while securing strength by formation of titanium or vanadium carbides in a region of 1000° C. or greater.

Although the present invention has been described with reference to the accompanying drawing and the exemplary embodiments, the present invention is not limited thereto, but is defined by the appended claims. Therefore, those skilled in the art will appreciate that the present invention may be variously modified and altered without departing from the scope and spirit of the invention as disclosed in the accompanying claims.

What is claimed is:

1. A ferritic steel comprising:
carbon (C) in an amount of about 0.05 to 0.12 wt %;
aluminum (Al) in an amount of about 3.0 to 7.0 wt %;
manganese (Mn) in an amount of about 0.5 wt % or less (not 0 wt %);
nickel (Ni) in an amount of about 0.5 wt % or less (not 0 wt %);
chromium (Cr) in an amount of about 0.75 wt % or less (not 0 wt %);
silicon (Si) in an amount of about 0.3 to 0.75 wt %;
a combined amount of titanium (Ti) and vanadium (V) in an amount of about 0.25 to 0.7 wt %; and
a balance being iron (Fe),
all the wt % are based on the total weight of the ferritic steel,
wherein the ferritic steel has yield strength of about 570 Mpa or greater.

2. The ferritic steel of claim 1, further comprising at least one selected from the group consisting of,
Niobium (Nb) in an amount of about 0.02 wt % or less;
Phosphorus (P) in an amount of about 0.1 wt % or less;
Sulfur (S) in an amount of about 0.05 wt % or less;
Nitrogen (N) in an amount of about 0.01 wt % or less.

3. The ferritic steel of claim 1, wherein the ferritic steel has tensile strength of about 611 Mpa or greater.

4. The ferritic steel of claim 1, wherein the ferritic steel has an elongation of about 10% or greater.

5. The ferritic steel of claim 1, wherein the ferritic steel has a density of about 7.0 to 7.5 g/cm3.

6. The ferritic steel of claim 1, wherein in the ferritic steel, a fraction of formed κ-carbide is less than about 1%.

7. The ferritic steel of claim 1, consisting essentially of:
carbon (C) in an amount of about 0.05 to 0.12 wt %;
aluminum (Al) in an amount of about 3.0 to 7.0 wt %;
manganese (Mn) in an amount of about 0.5 wt % or less (not 0 wt %);
nickel (Ni) in an amount of about 0.5 wt % or less (not 0 wt %);
chromium (Cr) in an amount of about 0.75 wt % or less (not 0 wt %);
silicon (Si) in an amount of about 0.3 to 0.75 wt %;
a combined amount of titanium (Ti) and vanadium (V) in an amount of about 0.25 to 0.7 wt %; and
a balance being iron (Fe),
all the wt % are based on the total weight of the ferritic steel.

8. The ferritic steel of claim 1, consisting of:
carbon (C) in an amount of about 0.05 to 0.12 wt %;
aluminum (Al) in an amount of about 3.0 to 7.0 wt %;
manganese (Mn) in an amount of about 0.5 wt % or less (not 0%);
nickel (Ni) in an amount of about 0.5 wt % or less (not 0%);
chromium (Cr) in an amount of about 0.75 wt % or less (not 0%);
silicon (Si) in an amount of about 0.3 to 0.75 wt %;
a combined amount of titanium (Ti) and vanadium (V) in an amount of about 0.25 to 0.7 wt %; and
a balance being iron (Fe),
all the wt % are based on the total weight of the ferritic steel.

9. The ferritic steel of claim 1, consisting essentially of:
carbon (C) in an amount of about 0.05 to 0.12 wt %;
aluminum (Al) in an amount of about 3.0 to 7.0 wt %;
manganese (Mn) in an amount of about 0.5 wt % or less (not 0%);
nickel (Ni) in an amount of about 0.5 wt % or less (not 0%);
chromium (Cr) in an amount of about 0.75 wt % or less (not 0%);
silicon (Si) in an amount of about 0.3 to 0.75 wt %;
a combined amount of titanium (Ti) and vanadium (V) in an amount of about 0.25 to 0.7 wt %; and
at least one selected from the group consisting of,
niobium (Nb) in an amount of about 0.02 wt % or less,
phosphorus (P) in an amount of about 0.1 wt % or less, sulfur (S) in an amount of about 0.05 wt % or less, and
nitrogen (N) in an amount of about 0.01 wt % or less; and a balance being iron (Fe), all the wt % are based on the total weight of the ferritic steel.

10. A vehicle comprising a ferritic steel of claim 1.

* * * * *